US009322159B1

(12) United States Patent
Evans, Jr.

(10) Patent No.: US 9,322,159 B1
(45) Date of Patent: Apr. 26, 2016

(54) CONSTRUCTION SPACERS AND METHOD

(71) Applicant: Jack W. Evans, Jr., Round Mountain, NV (US)

(72) Inventor: Jack W. Evans, Jr., Round Mountain, NV (US)

( * ) Notice: Subject to any disclaimer, the term of this patent is extended or adjusted under 35 U.S.C. 154(b) by 0 days.

(21) Appl. No.: 14/686,485

(22) Filed: Apr. 14, 2015

Related U.S. Application Data

(62) Division of application No. 14/558,355, filed on Dec. 2, 2014, now Pat. No. 9,003,738.

(60) Provisional application No. 61/963,311, filed on Dec. 2, 2013.

(51) Int. Cl.

| | |
|---|---|
| ***E04B 1/26*** | (2006.01) |
| ***E04B 7/04*** | (2006.01) |
| ***E04B 1/41*** | (2006.01) |
| ***E04B 5/02*** | (2006.01) |
| ***E04C 3/02*** | (2006.01) |
| *E04B 1/38* | (2006.01) |
| *E04B 5/12* | (2006.01) |

(52) U.S. Cl.
CPC ..... *E04B 1/2604* (2013.01); *E04B 1/40* (2013.01); *E04B 5/023* (2013.01); *E04C 3/02* (2013.01); *E04B 1/2608* (2013.01); *E04B 1/2612* (2013.01); *E04B 5/12* (2013.01); *E04B 2001/2644* (2013.01); *E04B 2001/405* (2013.01)

(58) Field of Classification Search
CPC ..... E04B 1/2608; E04B 1/2612; E04C 5/12; E04C 2001/2628; E04C 2001/2644; E04C 2003/026; E04C 3/02
USPC ..... 52/712, 715, 696, 698, 704, 707, 708
See application file for complete search history.

(56) References Cited

U.S. PATENT DOCUMENTS

| | | | | | |
|---|---|---|---|---|---|
| 631,352 | A | * | 8/1899 | Wilding | 403/231 |
| 783,807 | A | * | 2/1905 | Tuteur | 403/232.1 |
| 1,214,738 | A | * | 2/1917 | Wolf | 5/290 |
| 1,260,531 | A | * | 3/1918 | Fiala | 403/399 |
| 1,547,184 | A | * | 7/1925 | Venzie | 52/355 |
| 2,911,690 | A | * | 11/1959 | Sanford | 403/232.1 |
| 2,964,807 | A | * | 12/1960 | Kennedy | 52/696 |
| 2,990,590 | A | * | 7/1961 | Graveley | 403/189 |
| 3,036,347 | A | * | 5/1962 | Findleton | 403/217 |
| 3,091,822 | A | * | 6/1963 | Fiekers et al. | 403/394 |
| 3,256,030 | A | * | 6/1966 | Banse | 403/400 |
| 3,398,982 | A | * | 8/1968 | Venzie, Jr. | 52/714 |
| 3,615,110 | A | * | 10/1971 | Fugate | 403/230 |
| 3,669,480 | A | * | 6/1972 | Fugate | 403/400 |

(Continued)

*Primary Examiner* — Elizabeth A Plummer
*Assistant Examiner* — Kyle Walraed-Sullivan
(74) *Attorney, Agent, or Firm* — John D. Long, Esq.; Long & Chybik

(57) ABSTRACT

One possible embodiment of the invention could be a construction spacer for holding boards in a parallel and spaced-apart manner comprising a Y-shaped base having a first and second base ends, the first base end forming a C-shaped aperture; a pair of spaced apart J-shaped attachment arms that perpendicularly attaches to the first base end and further forms hook portions that together can hold a first board; a pair of lateral support arms that extends outward from the first body end; an L-shaped attachment arm that perpendicularly attaches to the second base end and forms a catch that can hold a second board parallel to the first board, wherein the C-shaped aperture can accept a second base end of another construction spacer to allow a plurality of construction spacers to be connected together in tandem order.

11 Claims, 11 Drawing Sheets

(56) References Cited

U.S. PATENT DOCUMENTS

| | | | | | |
|---|---|---|---|---|---|
| 3,945,741 | A * | 3/1976 | Wendt | 403/191 |
| 3,989,398 | A * | 11/1976 | Wendt | 403/230 |
| 4,022,537 | A * | 5/1977 | Gilb et al. | 403/386 |
| 4,102,587 | A * | 7/1978 | Herb et al. | 403/205 |
| 4,160,350 | A * | 7/1979 | Craib | 52/696 |
| 4,261,155 | A * | 4/1981 | Gilb | 52/702 |
| 4,318,628 | A * | 3/1982 | Mancini | 403/231 |
| 4,330,971 | A * | 5/1982 | Auberger | 52/210 |
| 4,366,659 | A * | 1/1983 | Jensen | 52/693 |
| 4,411,548 | A * | 10/1983 | Tschan | 403/232.1 |
| 4,455,805 | A * | 6/1984 | Rionda et al. | 52/712 |
| 4,480,941 | A * | 11/1984 | Gilb et al. | 403/232.1 |
| 4,527,375 | A * | 7/1985 | Braginetz | 52/712 |
| 4,560,301 | A * | 12/1985 | Gilb | 403/232.1 |
| 4,572,695 | A * | 2/1986 | Gilb | 403/232.1 |
| 4,594,017 | A * | 6/1986 | Hills | 403/6 |
| 4,625,415 | A * | 12/1986 | Diamontis | 33/613 |
| 4,715,741 | A * | 12/1987 | Kulbersh | 403/389 |
| 4,717,279 | A * | 1/1988 | Commins | 403/187 |
| 4,724,642 | A * | 2/1988 | Hoffman et al. | 52/298 |
| 4,825,621 | A * | 5/1989 | Jensen | 52/702 |
| 5,004,369 | A * | 4/1991 | Young | 403/232.1 |
| 5,111,632 | A * | 5/1992 | Turner | 52/702 |
| 5,186,571 | A * | 2/1993 | Hentzschel | 403/231 |
| 5,217,317 | A * | 6/1993 | Young | 403/232.1 |
| 5,230,198 | A * | 7/1993 | Callies | 52/702 |
| 5,253,465 | A * | 10/1993 | Gilb | 52/643 |
| 5,274,981 | A * | 1/1994 | Commins | 52/712 |
| 5,297,383 | A * | 3/1994 | Mackay | 52/712 |
| 5,307,603 | A * | 5/1994 | Chiodo | 52/698 |
| 5,412,920 | A * | 5/1995 | Hess | 52/712 |
| 5,437,132 | A * | 8/1995 | Meyers | 52/410 |
| 5,442,887 | A * | 8/1995 | Welsh | 52/92.2 |
| 5,448,871 | A * | 9/1995 | Newman et al. | 52/712 |
| 5,457,928 | A * | 10/1995 | Sahnazarian | 52/702 |
| 5,560,156 | A * | 10/1996 | McDonald | 52/92.2 |
| 5,564,248 | A * | 10/1996 | Callies | 52/702 |
| 5,603,580 | A * | 2/1997 | Leek et al. | 403/232.1 |
| 5,625,993 | A * | 5/1997 | Kelly | 52/704 |
| 5,653,079 | A * | 8/1997 | Loeffler et al. | 52/712 |
| 5,699,639 | A * | 12/1997 | Fernandez | 52/707 |
| 5,797,694 | A * | 8/1998 | Breivik | 403/231 |
| 5,836,131 | A * | 11/1998 | Viola et al. | 52/702 |
| 5,884,448 | A * | 3/1999 | Pellock | 52/643 |
| 6,230,466 | B1 * | 5/2001 | Pryor | 52/702 |
| 6,295,780 | B1 * | 10/2001 | Thompson | 52/712 |
| 6,295,781 | B1 * | 10/2001 | Thompson | 52/712 |
| 6,332,299 | B1 * | 12/2001 | Stewart, III | 52/696 |
| 6,415,572 | B1 * | 7/2002 | MacKarvich | 52/357 |
| 6,446,409 | B1 * | 9/2002 | Emerson | 52/712 |
| 6,463,711 | B1 * | 10/2002 | Callies | 52/702 |
| 6,510,666 | B1 * | 1/2003 | Thompson | 52/712 |
| 6,560,943 | B1 * | 5/2003 | Leek et al. | 52/715 |
| 6,622,448 | B1 * | 9/2003 | Sonne | 52/656.1 |
| 6,662,517 | B1 * | 12/2003 | Thompson | 52/714 |
| 6,837,019 | B2 * | 1/2005 | Collie | 52/712 |
| 6,877,291 | B2 * | 4/2005 | Shamroukh et al. | 52/702 |
| 6,922,967 | B2 * | 8/2005 | Collie | 52/656.9 |
| 6,931,813 | B2 * | 8/2005 | Collie | 52/713 |
| 7,021,021 | B2 * | 4/2006 | Saldana | 52/696 |
| 7,448,171 | B1 * | 11/2008 | diGirolamo et al. | 52/92.2 |
| 7,987,636 | B2 * | 8/2011 | Hunt | 52/92.2 |
| 8,443,564 | B2 * | 5/2013 | Bankston, Jr. | 52/506.07 |
| 8,453,409 | B2 * | 6/2013 | Oliver et al. | 52/538 |
| 8,677,718 | B2 * | 3/2014 | Marshall | 52/655.1 |
| 8,683,772 | B2 * | 4/2014 | Friis | 52/691 |
| 8,720,155 | B1 * | 5/2014 | Robell | 52/702 |
| 2002/0020137 | A1 * | 2/2002 | Commins | 52/712 |
| 2004/0163355 | A1 * | 8/2004 | Collie | 52/702 |
| 2004/0206031 | A1 * | 10/2004 | Mow | 52/459 |
| 2005/0011157 | A1 * | 1/2005 | Lutz et al. | 52/698 |
| 2005/0120669 | A1 * | 6/2005 | Harrison | 52/733.2 |
| 2006/0130414 | A1 * | 6/2006 | Walther | 52/289 |
| 2006/0156682 | A1 * | 7/2006 | McAndrew et al. | 52/729.1 |
| 2007/0012847 | A1 * | 1/2007 | Tai | 248/343 |
| 2007/0119108 | A1 * | 5/2007 | Downard | 52/289 |
| 2007/0200039 | A1 * | 8/2007 | Petak | 248/219.1 |
| 2008/0101855 | A1 * | 5/2008 | Lin | 403/232.1 |
| 2008/0134620 | A1 * | 6/2008 | Contasti | 52/712 |
| 2009/0113839 | A1 * | 5/2009 | Carr | 52/712 |
| 2009/0151294 | A1 * | 6/2009 | Staley | 52/655.1 |
| 2009/0178362 | A1 * | 7/2009 | Jerke | 52/656.9 |
| 2011/0107710 | A1 * | 5/2011 | Sias | 52/655.1 |
| 2011/0225924 | A1 * | 9/2011 | Carbonaro et al. | 52/698 |
| 2013/0067850 | A1 * | 3/2013 | Sasanecki | 52/702 |
| 2013/0247499 | A1 * | 9/2013 | Zimmerman et al. | 52/582.1 |
| 2014/0144099 | A1 * | 5/2014 | Sareyka | 52/704 |
| 2014/0182236 | A1 * | 7/2014 | Doupe et al. | 52/705 |
| 2014/0318073 | A1 * | 10/2014 | Sidhu | 52/702 |

* cited by examiner

CONSTRUCTION SPACERS AND METHOD

STATEMENT REGARDING FEDERALLY SPONSORED RESEARCH OR DEVELOPMENT

Not Applicable

REFERENCE TO A "MICROFICHE APPENDIX"

Not Applicable.

FIELD OF THE INVENTION

The present invention may relate to construction spacers used to align and attach boards in a uniform, parallel and spaced-apart manner to form walls, floors, roofs and the like. More particularly, the present invention may relate to those construction spacers that may be tandemly aligned together when attached to boards.

BACKGROUND

Building construction may utilize a plurality of spaced-apart boards (e.g., wood, metal, composite, etc.) as attached to one or more support members to generally form framing for horizontal (e.g., walls) and vertical (e.g., floors and roofs) structural elements. This type of construction generally requires that the boards have uniform spacing and alignment to support members substantially ensure that resulting structure has the minimum amount of needed support (e.g. load bearing capability) as provided by the boards. This uniform board spacing and alignment may also be required if additional materials and devices that have established dimensions are to be embedded within the completed structural element.

Besides using marking for board spacing and alignment, measured and cut wooden blocks can be as board spacers (e.g., either as movable spacers or as permanent spacers attached to the support members.) When the boards are then attached to the support members between the wooden blocks, the boards can be considered to be properly spaced. The boards can be also fastened to the attached wooden blocks for additional support.

This manner of board spacing, alignment and attachment may result in higher construction costs in the terms of manpower and materials in that construction workers may have to expend additional time to measure and mark support boards or measure, cut and use spacing blocks to otherwise delineate the board attachment points on the support members.

What could be needed is the present invention, which may not only significantly reduce the need to measure and mark the boards' attachment points but may further assist the board attachment to respective structural members as well as further increase the overall structural integrity of the completed structural element. One possible use of the embodiment of the invention could be a construction spacer or bracket having a Y-shaped base. Perpendicularly attached to the Y end of the base could be a pair of spaced-apart J-shaped attachment arms while an L-shaped attachment arm is perpendicularly attached to remaining base end. An outwardly extending lateral arm could be respectively attached to each side of the Y-shaped base proximate to the pair of spaced-apart J-shaped attachment arms. Both the J- and L shaped attachment arms can descend from the underside of the Y-shaped base with the J-shaped attachment arm pair generally facing the L-shaped attachment arm. The two extension supports could further define a C-shaped aperture that can accommodate the second base end of another construction spacer so allow the construction spacers to attach to one another in a sequential and tandem (e.g., front-to-end) manner.

In use, one construction spacer can hold onto a pair of boards in a spaced-apart and parallel orientation with the wide or face portions of the boards facing one another. A second construction spacer can place its pair of spaced-apart J-shaped attachment arms so that the pair straddles the Y-shaped base of the first construction spacer to allow the pair to further attach to the board being held by the first construction spacer's L-shaped attachment arm. In this manner, the second base end of the first construction spacer can be held by the C-shaped aperture of the second construction spacer. A third board could fitted to the L-shaped attachment arm of the second construction spacer with a third construction spacer repeating the pattern of J-shaped attachment arm attachment. Additional construction spacers could be added in this manner until all the boards of the set forming the structural element are attached and supported by the construction spacers. As needed to complete the structural element, the extension arms may be used to attach the respective construction spacer to the set of boards; abutting special members; or to abutting boards from other sets of boards. In this manner, the construction spacers can be linked in tandem in a way that may be perpendicular to the relative orientation of the spaced-apart boards forming the structural element.

SUMMARY OF ONE EMBODIMENT OF THE INVENTION

Advantages of One or More Embodiments of the Present Invention

The various embodiments of the present invention may, but do not necessarily, achieve one or more of the following advantages:

the ability to align and secure wall studs, floor joists, roof rafters and the like in proper place and alignment without having to measure and mark board attachment points on the respective support members;

to provide construction spacers that can be assembled in an inline or tandem manner so as to provide proper alignment and attachment of spaced-apart boards to respective support member(s) in the construction of a structural element;

the ability to interlock construction spacers inline or in a tandem manner for the attachment of a set of boards to generally increase the structural integrity of the resulting structural element;

to provide a construction spacer that can simultaneously align and attach to two different spaced-apart boards forming two different support elements;

the ability to reduce the time, skill and associated labor cost needed to align and attach spaced-apart boards comprising a structural element;

to provide floors, roofs and walls with greater strength and durability; and the ability to eliminate the need for short wooden blocks for board spacing, alignment, and attachment in a structural element.

These and other advantages may be realized by reference to the remaining portions of the specification, claims, and abstract.

Brief Description of One Embodiment of the Present Invention

One possible embodiment of the invention could a construction spacer for spacing and attaching a set of boards in spaced-apart and parallel manner, generally comprising a Y-shaped base comprising a base of definite length terminating in a first base end that is wider than a second base end, the first base end supporting two spaced-apart extension supports that form a C-shaped aperture that can accept an L-shaped attachment arm from another construction spacer; a pair of spaced-apart J-shaped attachment arms, the J-shaped arm comprising a strip that terminates in a first strip end and a second strip end, the first strip end perpendicularly attaches to and descends down from a respective extension support, the second strip end forms a J-shaped hook projection that has a tip that is apart from and parallel to a non-hook portion of the strip; a pair of lateral support arms, the lateral support arm attaches to and extends outward from a respective extension support; an L-shaped attachment arm that has an elongated rectangular plate that terminates in a first plate end and a second plate end, the first plate end perpendicularly attaches to and descends from the second base end of the base, the second plate end projects out a tab that is perpendicular to the rest of the rectangular plate and faces the J-shape projections of the J-Shaped attachment arm pair; wherein the J-shape hook projection can engage and support a lengthwise edge of a first board of a set of boards while the tab can engages and supports a lengthwise edge of second board of the set of boards, the supported board being held by the construction spacer in a parallel and spaced-apart fashion.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
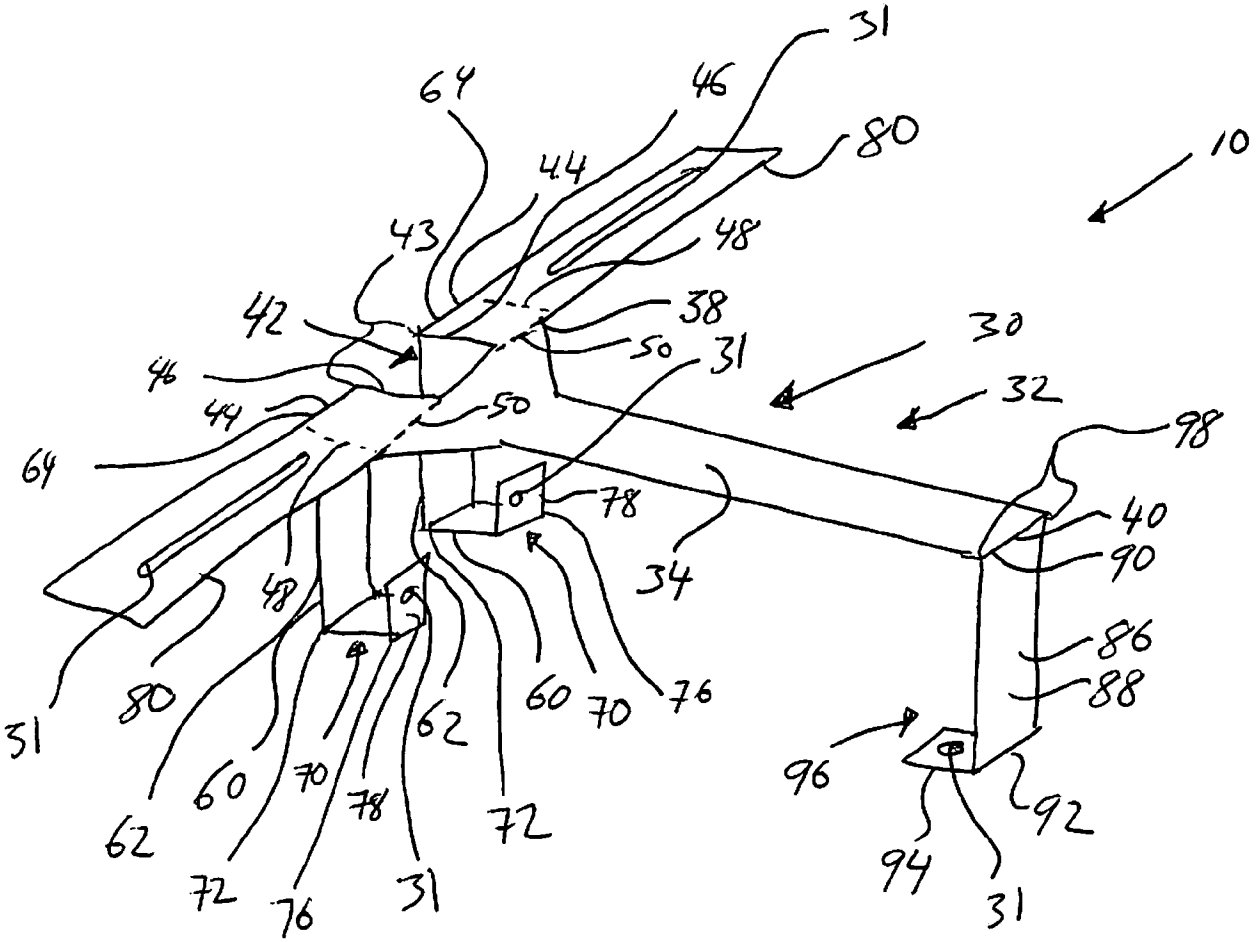
FIG. 1 is substantially a perspective view of one embodiment of the construction spacer of the present invention.

The present invention 10 could comprise a construction spacer 30 and a method 200 for using same. A plurality of these construction spacers 30 could be tandemly attached to one another (e.g., one behind the other) to substantially attach to and align a set of boards 12 in a parallel, spaced-apart orientation (e.g., so that faces or wide portions of the boards [rather than the board's edges] face one and other.) The combination of construction spacers and set of boards 12 may form a structural element 24 (e.g., a wall, floor, roof and alike) that is incorporated into a building construction (as substantially shown in FIGS. 6-11.) As substantially shown in FIG. 1, the construction spacer 30 in one embodiment could be a bracket 32 made from a sheet of metal, the metal being, in at least possible embodiment, a carbon steel alloy of A36 format. The construction spacer 30 could comprise a Y-shaped base 34, a pair of J-shaped attachment arms 60, a pair of lateral arms 80, and an L-shaped attachment arm 86. The Y-shaped base 34 could terminate in a first base end 38 and a second base end 40, the first base end 38 could further comprise of a pair of spaced-apart support extensions 42 to which a pair of spaced-apart J-shaped attachment arms 50 could be perpendicular attached. The spaced-apart support extension pair 42 could further support a pair of lateral arms 80, each lateral arm 80 extending outward from a respective side of the Y-shaped base 34. The remaining or second base end 40 could perpendicularly mount an L-shaped attachment arm 86. In this manner, both the pair of J-shaped attachment arms 60 and the L-shaped attachment arm 86 could descend from the underside of the Y-shaped base 34. The hook portions 70 of the J-shaped attachment arm pair 60 and the tab 94 of the L-shaped support arm 86 could generally be facing one another.

Figure 2:
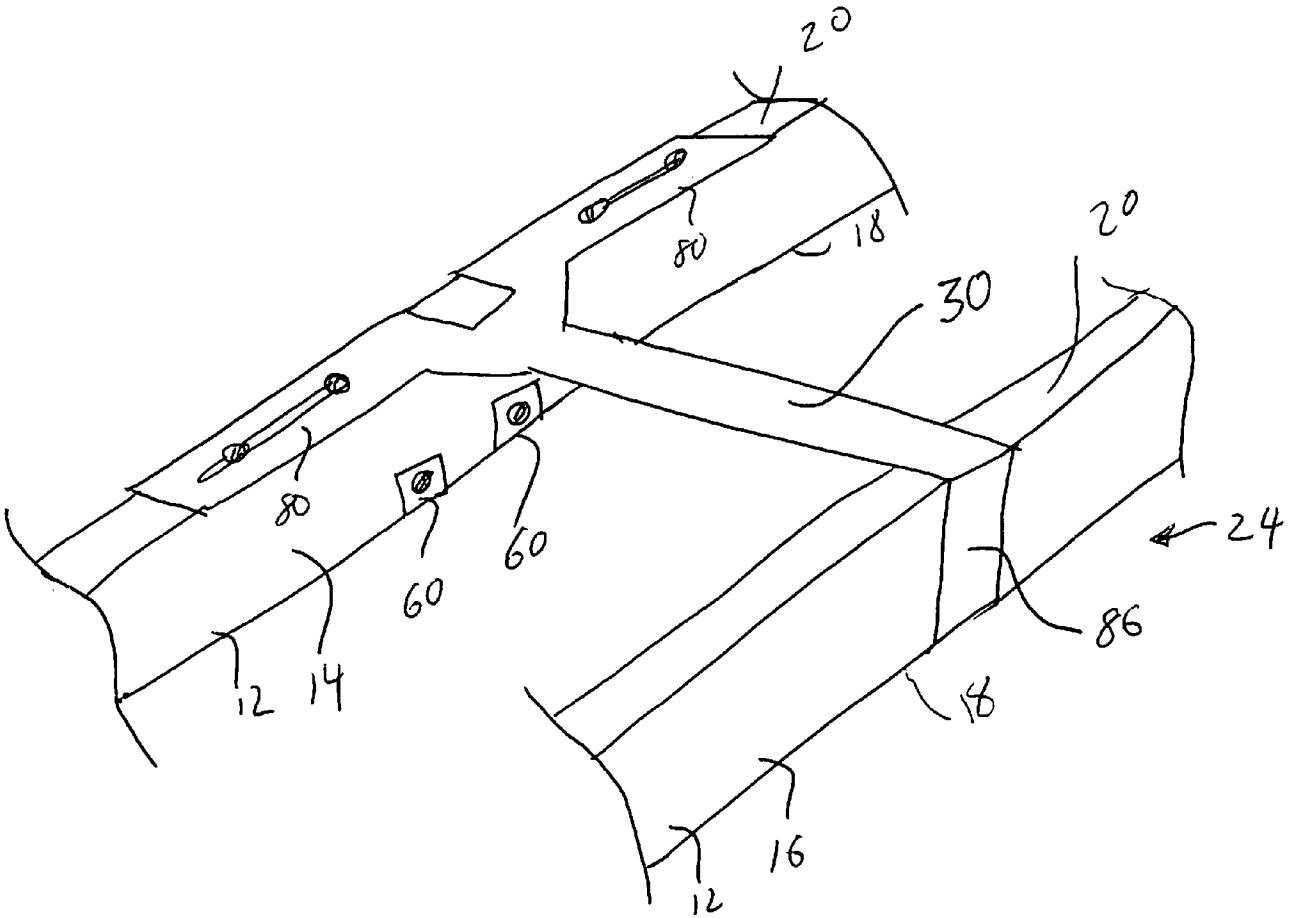
FIG. 2 is substantially a perspective view of one embodiment of the construction spacer attached to the middle portion of two boards from a first set of boards.
Figure 3:
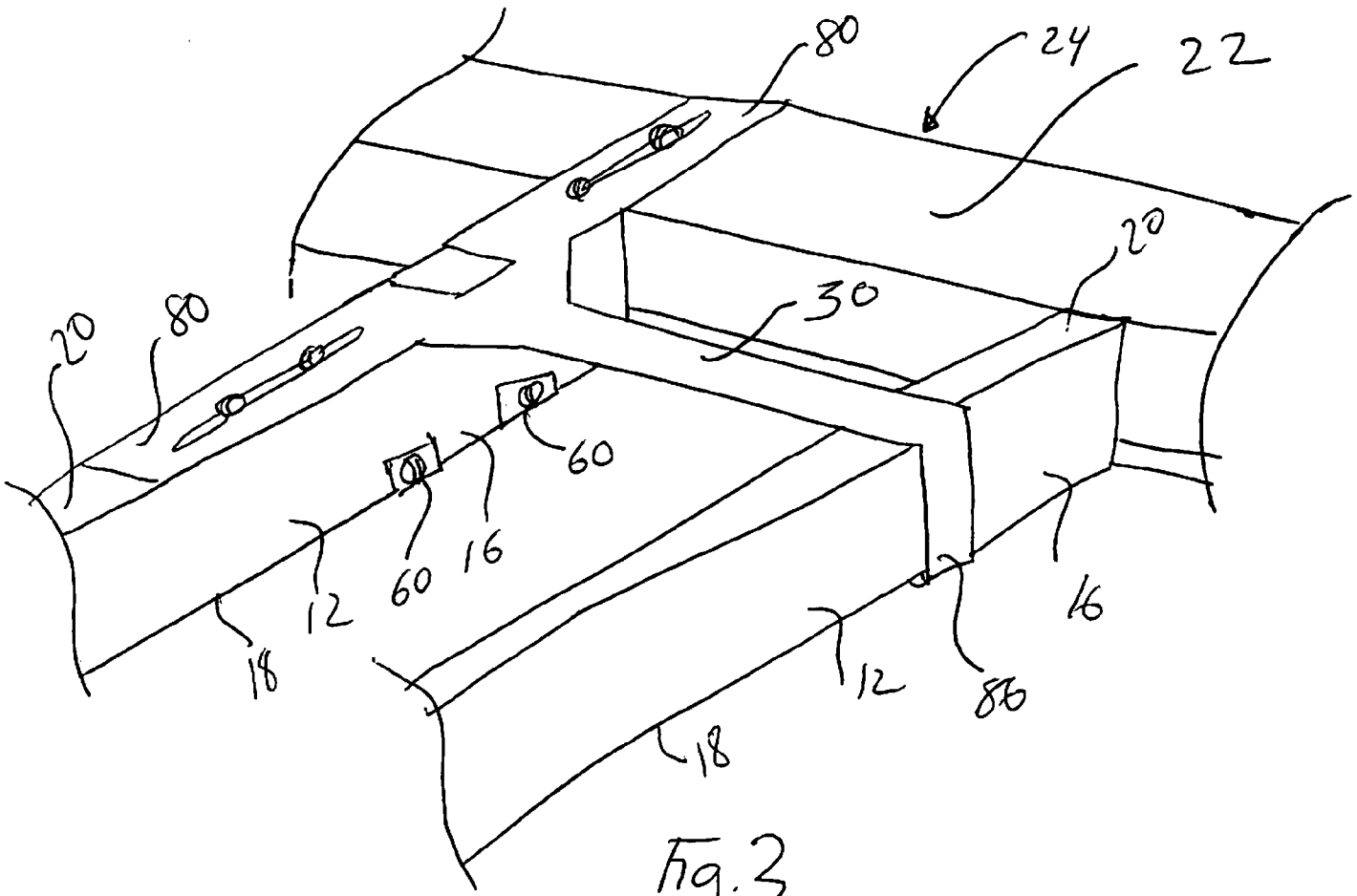
FIG. 3 is substantially a perspective view of one embodiment of the construction spacer attached to two boards of a first set of boards and a support member.
Figure 4:
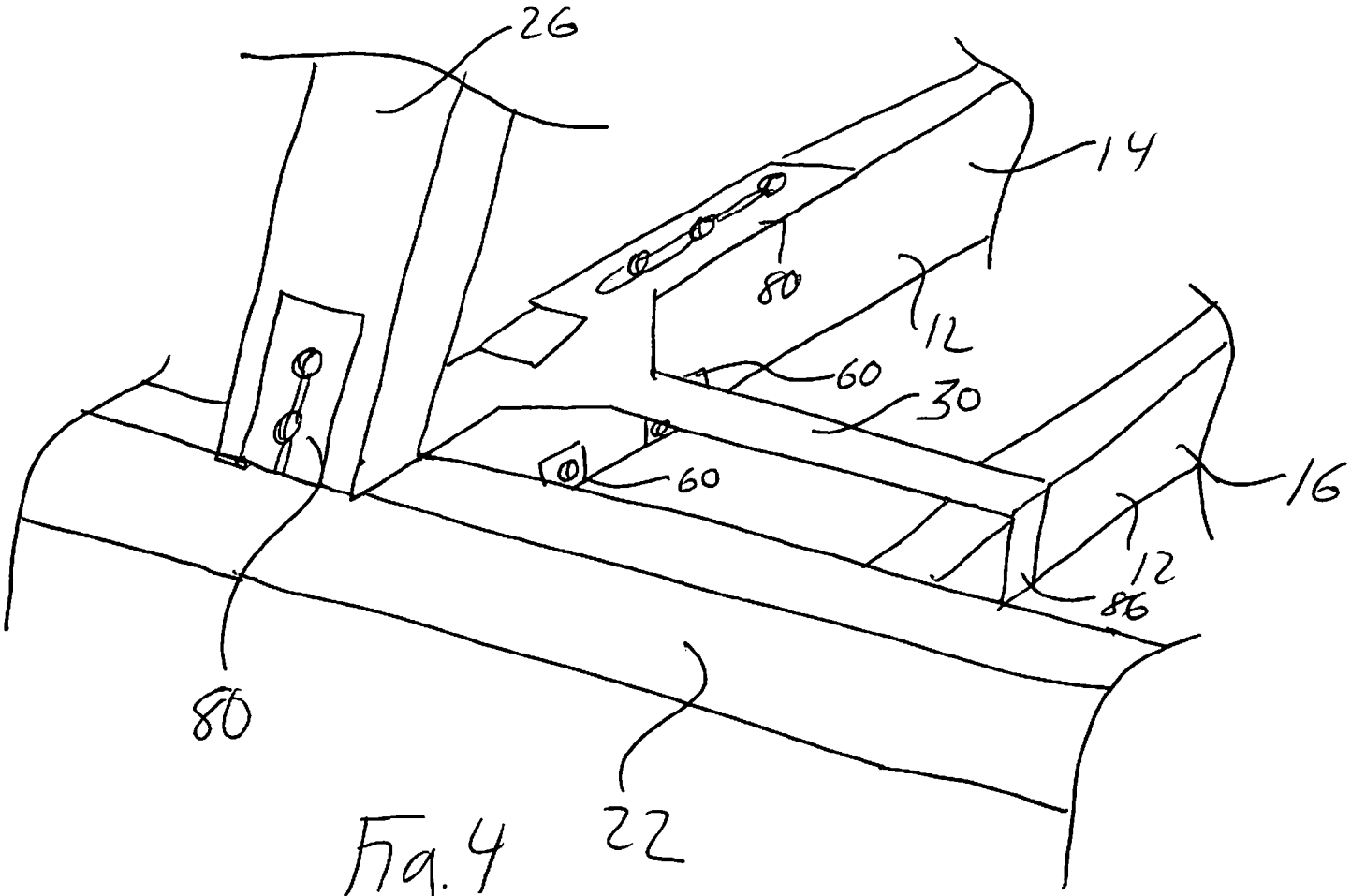
FIG. 4 is substantially a perspective view of one embodiment of the construction spacer attached to two boards of a first set, another board from another set, and a support member.

As substantially shown in FIG. 2, in operation, the J-shaped support arms 60 could both hold onto and support a first board 14 from a set of boards 12 while the L-shaped support arm 86 could hold onto a second board 16 from the set of boards 12 to help form a structural element 24 (e.g., wall, floor, roof, etc.) As substantially shown in FIGS. 2, 3, 4 the lateral arms 80 could attach to the first board 14, and/or to an abutting support member 22, and/or to other boards 26 from another set of boards. To further aid the attachment of the construction spacer 30 to the boards 12 and support members 22, the construction spacer 30 could be suitably perforated with fastener apertures 31 to substantially allow passage of suitable fasteners 33 (e.g., nails, screws, bolts and the like) through the construction spacer 30 to allow the construction spacer 30 to be attached to boards 14, 16, abutting support member(s) 22 and the like.

The Y-shaped base 34 could comprise of a body 36 of definite length terminating in two base ends, a first base end 38 generally being wider (e.g., generally triangular in shape) than the second base end 40. The first base end 38 in supporting the pair of spaced-apart support extensions 44 could substantially form a C-shaped aperture 42 that could be wide enough to accommodate second base end 40 from another construction spacer 30. Each support extension 44 could be square-shaped and may have four edges: an inner edge 46 that helps form the C-shaped aperture 42; an outside edge 48 that attaches to a respective outwardly facing lateral arm 80; a rear edge 50 by which the support extension 44 may attach to the first base end 38; and a front edge 52 by which a respective J-shape attachment arm 60 may perpendicularly attach to the support extension 44.

The J-shaped attachment arm 60 could comprise of an elongated rectangular strip 62 terminating at two strip ends, a first strip end 64 that may attach perpendicularly to the respective support extension 44, while the remaining second strip end 66 may form a hook portion 70 by substantially utilizing two width-wise bends (e.g., 90 degree angle bends) that traverse the second strip end 66. The first bend 72 may form the strip base 74 of the hook portion 70 with the strip base 75 generally being perpendicular to the non-hook portion of the strip 62.) The second bend 76 may form a strip tip 78 of the hook portion 70, the strip tip 78 being generally spaced-apart from and parallel to the non-hook portion of the strip base 70.) Both the J-shaped attachment arms 60 can be seen as descending from the Y-shaped base 34 in same plane as each other and in a spaced-apart fashion. The hook portion 70 of each J-shaped support arm 60 could be seen as being formed and capable of accepting and supporting a portion of a first board's first [e.g., bottom] lengthwise edge 18.

Each lateral arm 80 could be seen as extending outward from a respective outside edge 48 of the support extensions 44 to substantially impart a secondary T-shape to the body 36. The positioning of the lateral arms 50 could allow both lateral arms 50 to contact a second lengthwise (e.g., top) edge 20 of a first board 14 (as substantially shown in FIG. 2) that is otherwise held by the J-shaped attachment arms 60 if the construction spacer 32 is substantially placed upon a non-end portion of the supported board. As substantially shown in FIG. 3, if the construction spacer 30 attaches to the portions of the two boards 12 that otherwise abuts a respective support member 22 (to generally form the first structural element 24, e.g., a floor), then one lateral arm 80 could be directed the support member 22 for attachment. As substantially shown in FIG. 4, under certain instances wherein another board 26 (e.g., a board from another set of boards being used to substantially form another structural element 24 [e.g., a wall]) that is not otherwise being held by the construction spacer's J and S-shaped attachment arms 60, 86) and abuts a common structural element 24 then the remaining lateral arm 80 could be bent (e.g., by the construction worker) in a perpendicular manner to the Y-shaped base 34 to attach the remaining lateral arm 80 to a lengthwise edge of the other board 26.

The L-shaped attachment arm 85 could comprise of an elongated rectangular plate 88 having two plate ends, first plate end 90 that could perpendicularly mount the L-shaped attachment arm 86 to the second end of the Y-shaped base 36. The second plate end 92 could have widthwise bend (e.g., ninety° degree bend) that generally traverses the second plate end 92 to substantially form a tab 94 or a foot of the L-shape attachment arm 86 to form a catch 96. The tab 94 could be perpendicular to the remaining (e.g., non-catch portion) of the elongated rectangular plate 88. The width 98 of the rectangular plate 88 could be the same or less than width 43 of the C-shaped aperture 42 to substantially allow the second base end 40 to pass into a C-shaped aperture of another construction spacer 30 for an inline tandem (e.g., front-to-end) connection of the construction spacers 30.

The L-spaced attachment arm 86 could be seen as being formed and capable of accepting and supporting a second board 16 (e.g., first and second boards 14, 16 being from the same set 12 generally share the same dimensions, such as width and thickness). Like the J-shaped attachment arm pair 60, the L-shaped attachment arm 86 (e.g., by the tab 94) could support a portion of a second board's first (e.g., bottom) lengthwise edge 18.

As needed, the construction spacer 30 (e.g., the Y-shaped base 34, J-shaped attachment arm pair 60, lateral arm pair 80 and the L-shaped attachment arm 86) could be specifically formed to meet the actual dimensions of set(s) of boards 12 being used in a certain construction projects. In the alternative, the construction spacer 30 could be formed for certain applications (floor joists assembly, roof rafter assembly; etc.) or for certain board types (2×4, 4×6) or a combinations thereof.

Figure 5:
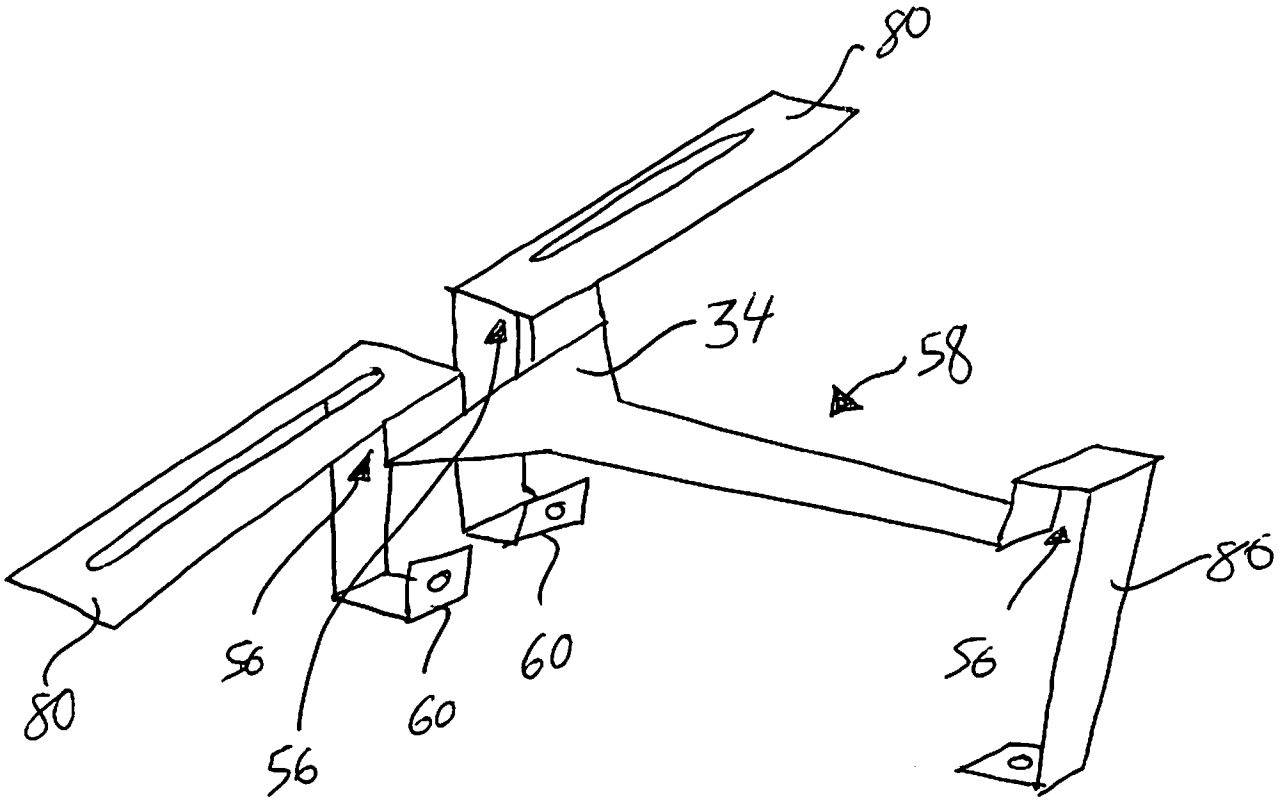
FIG. 5 is substantially a perspective view of one embodiment of the cathedral ceiling rafter construction spacer of the present invention.
Figure 6:
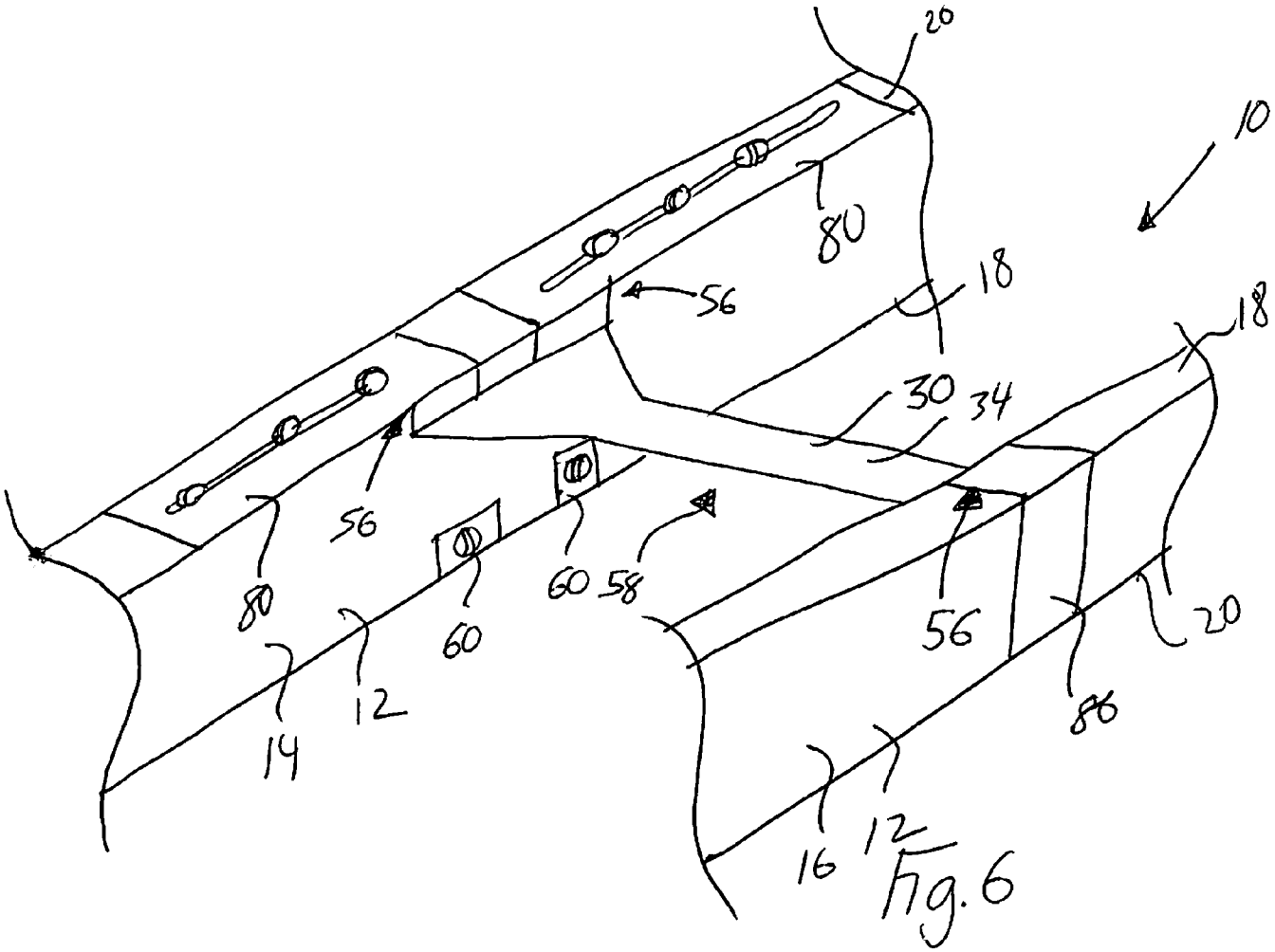
FIG. 6 is substantially a perspective view of one embodiment of the cathedral ceiling rafter construction spacer of the present invention, the cathedral ceiling rafter construction spacer being attached to two boards.
Figure 7:
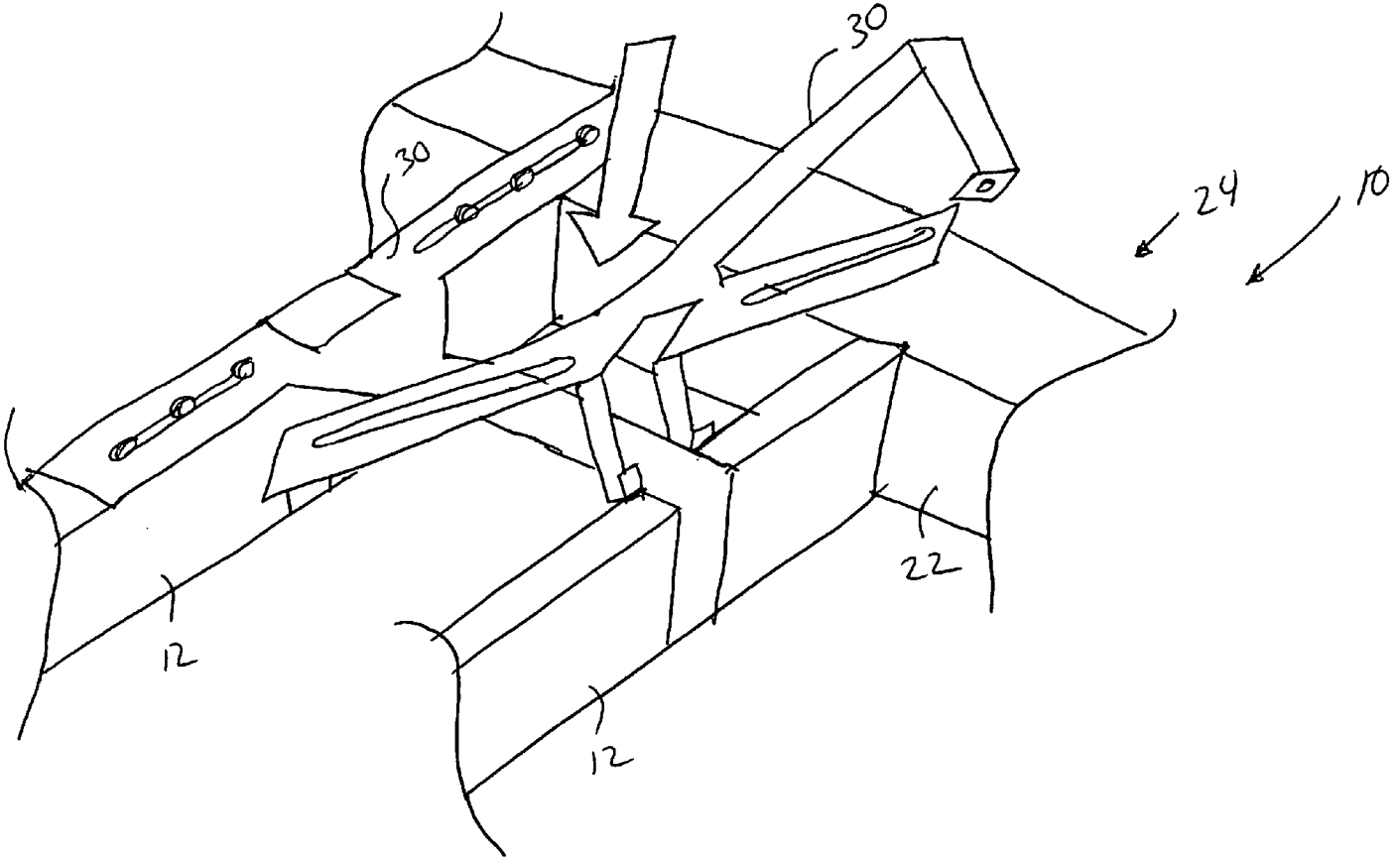
FIG. 7 is substantially a perspective view of a second construction spacer being angled over a first construction spacer.
Figure 8:
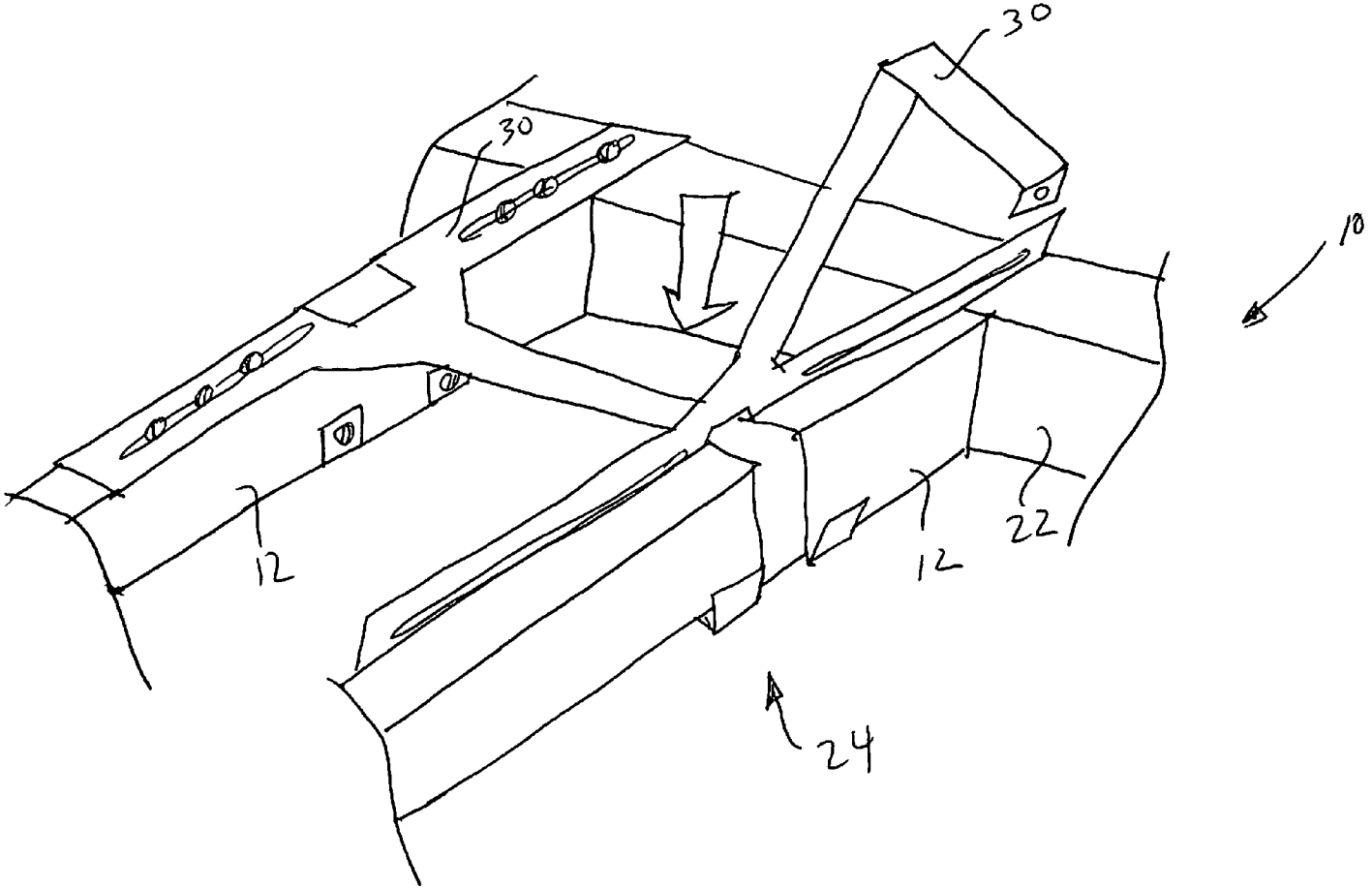
FIG. 8 is substantially a perspective view of the J-shaped attachment arms of the second construction spacer straddling the first construction spacer to engage the board held by the L-shaped attachment arms of the first construction spacer.
Figure 9:
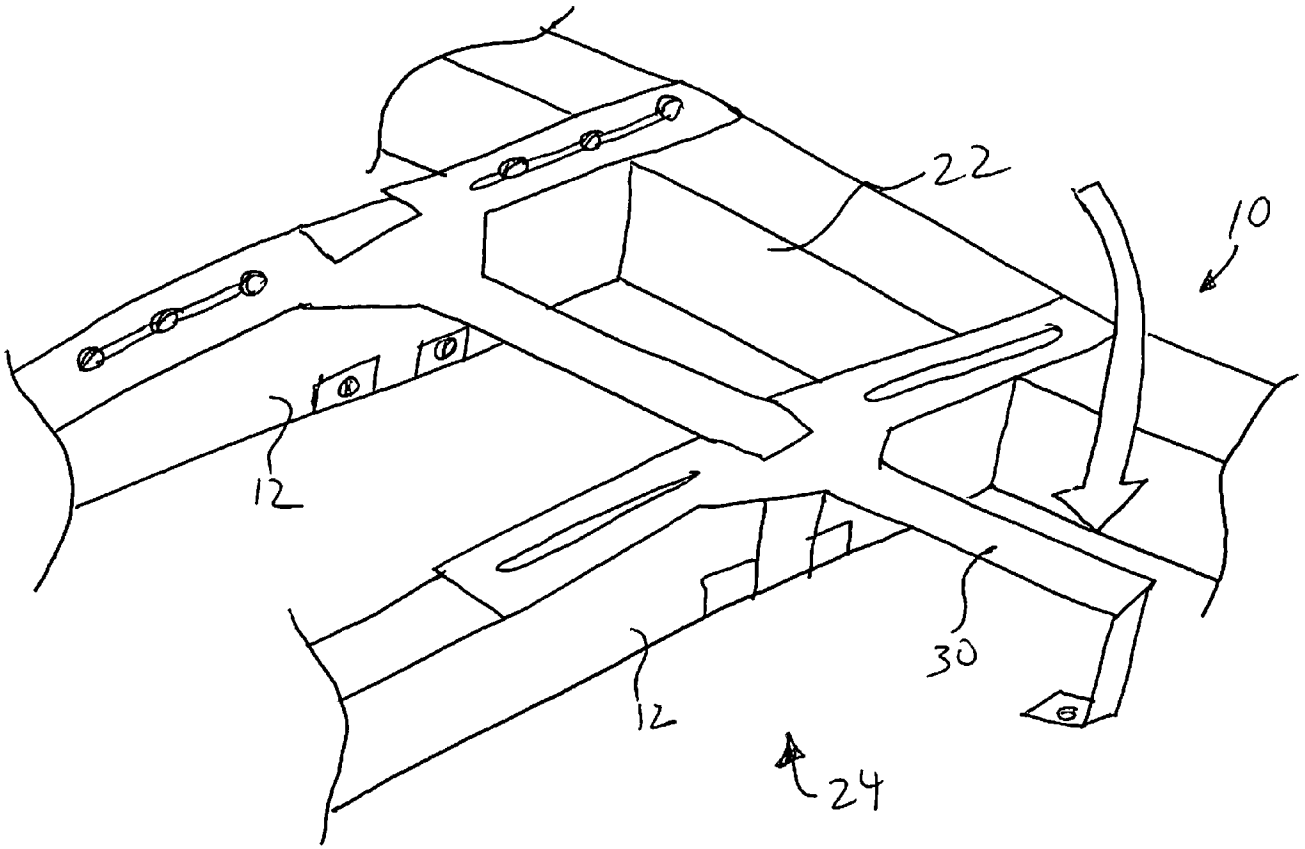
FIG. 9 is the second construction spacer pivoting down to fully engage the second board and the first construction spacer.
Figure 10:
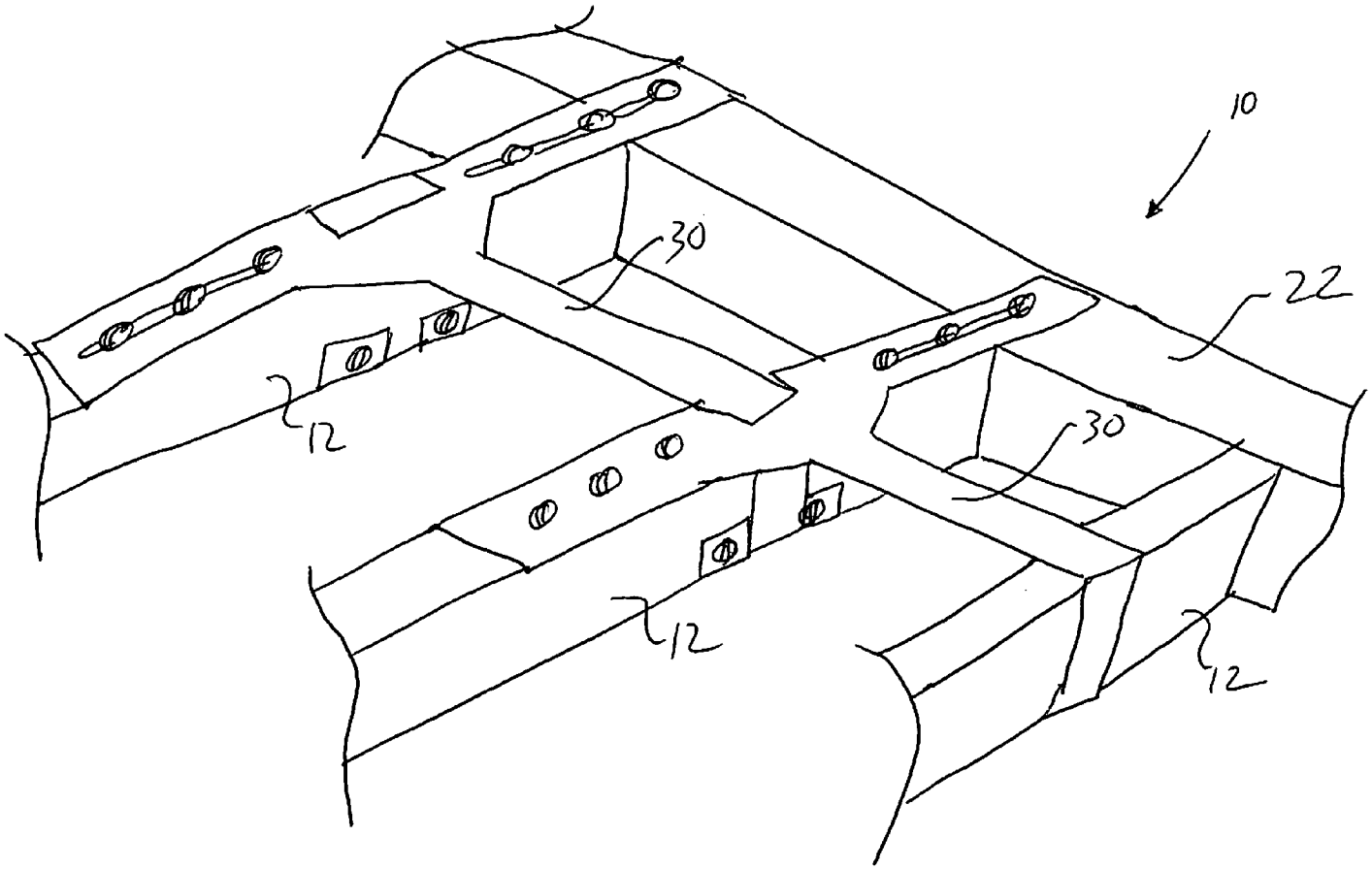
FIG. 10 is second construction spacer attached to the second board with a third board being supported second construction spacer's L-shaped attachment arm to allow the process to repeat for the attachment of another construction spacer.
Figure 11:
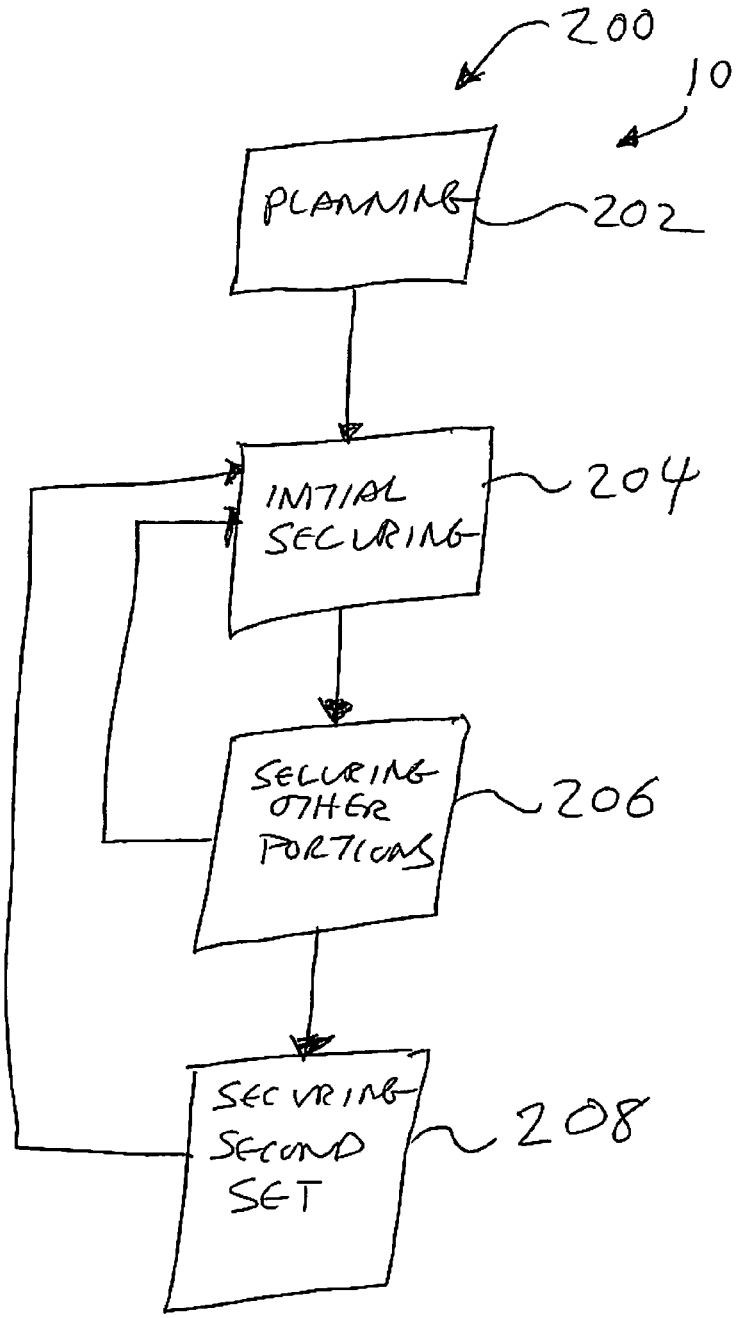
FIG. 11 is the substantially a flowchart schematic showing one possible embodiment of a process/method for using the construction spacer of the present invention.

As substantially shown in FIGS. 5 and 6, another embodiment of the invention 10 could be used with aligning and attaching rafters used to construct cathedral ceiling type structural element 24. In this embodiment of the construction spacer 30, the Y-shaped base 34 could be further constructed to be bent downward between the two base ends 38, 40 to generally form a U-shape depression 54 with the arms of the U forming respectively forming with the first ends of the both J-shaped and L-shaped support arms a plurality of holding cups 56 that could receive and attach to the second (e.g. top) lengthwise or longitudinal edges 18 of the boards 12 that are otherwise supported by the respective J-shaped and S-shaped attachment arms 60, 86 of a respective construction spacer 30. The base's U-shape depression 54 could be seen as providing a spacing 58 that could lift away any roll of insulation (not shown) that could be placed between a pair of construction spacer suspended boards 12 from any roofing material that could be subsequently placed upon the cathedral ceiling type structural element 24. The spacing 58 could generally forming air channels between the insulation and roofing/structural element allowing free flow of air that could prevent undesired condensation from occurring on between the insulation and the roofing. If otherwise not mitigated, the condensation could lead to rot in and mold formation upon the formed structural element 24.

As substantially shown in FIGS. 7-11, one possible method, procedure or process 200 of using the construction spacer 30 could start with step 202, planning structural element construction. In this step, the operator (e.g., such as an engineer, general contractor, framing sub-contractor, or like) could plan out the construction of the structural elements (e.g., floors, walls, roof, etc.) that will ultimately constitute the framing of the building. Depending on a variety of construction factors (e.g., weight-bearing load capability, movement stress, load transference, etc.), the board type and dimensions can be decided upon along with the corresponding measurements and suitable characteristics for those construction spacers to be used for boards attachment to corresponding support members and for the boards overall alignment. Once such planning is substantially completed, the boards, supporting members, construction spacers, fasteners and other needed materials can be suitably procured and delivered to the construction site. Once this step is substantially completed, the process 200 could proceed to step 204, initially securing the boards.

At step 204, initially securing the boards, one possible manner of initial assembly could be done in situ upon the partially completed building frame with the set of boards being placed one board at a time against the respective member support(s). In another embodiment, initially structural element assembly could possibly be accomplished in a horizontal manner on the ground or floor after which the completed structural element could then be lifted; moved into place and suitably attached using the placed construction spacers to attach the structural element other portions of the existing building frame.

In the first means of assembly, one measured mark could be placed at one end of a first support member(s) to identify when on the support member(s) the first board of the set is to be attached. No additional marking of the first support member is generally required for the spacing, alignment or attachment of the boards. As the first end of the first board is generally being aligned with the measured mark, the first construction spacer could be placed upon an end of the first board by generally placing the hooks of the J-shaped attachment arms on or around the first (e.g., bottom) lengthwise edge of first board. The remainder of the first construction spacer could then be pivoted around the hook portions of the J-shaped attachment arms so that underside of the support extensions comes down and over the first board's second (e.g., top) lengthwise edges to lock the first board in place to construction spacer. Appropriate fasteners could then pass through suitable fastener apertures to attach the J-shaped attachment arms to the first board (e.g., and through one extension arm to the second [top] lengthwise edge of the first board and then through the other extension arm to a portion of the first support member.) A second board from the set could similarly be brought up to abut the first support member in a manner to engage the tab or foot of the L-shaped support arm of the first construction spacer. Fastener(s) again could be employed to now attach the L-shaped attachment arm of the first construction spacer.

A second construction spacer could be brought close to the second board wherein the second construction spacer could be tilted up relative to the second board to allow the second construction spacer's J-shaped attachment arms straddle and then pass by the first construction spacer's Y-shaped base and L-shaped arm to generally sandwich portions of the first construction spacer's second base and respective L-shaped arm between the second construction spacer's J-shaped attachment arms. The second construction spacer's J-shaped attachment arm hook portions could then engage a portion (e.g., by the sides of the first construction spacer's tab or foot) of the first lengthwise edge (bottom) of the second board. The second's construction spacer could be swung down to pivot around the second construction spacer's J-shaped attachment arms hook portions to bring the second construction spacer's support extension's undersides down upon the second board's second lengthwise (e.g. top). In this manner, the second construction spacer's J-shaped attachment arm pair and the first construction spacer's L-shaped arm can be seen as sandwiching a portion of the second board with the respective hook portions abutting the respective tab.

The second construction spacer's J-shaped attachment arm pair and lateral arm pair could be attached to the second board (and to the first support member as appropriate) by suitable fasteners. A third board of the set could be brought to abut the first support member and be placed in contact with second construction spacer's L-shaped attachment arm, the first lengthwise (bottom) edge of the third board being appropriately being supported by the tab or foot of that L-shaped attachment arm. Fastener(s) can then be used to attach that third board to that L-shaped attachment arm. This process then being repeated with subsequent boards being attached to the first support member as the construction spacers themselves are locked in place to one another in a tandem fashion to generally offer increased mutual support strength and attachment for the set of boards which themselves as a rest of this process become interlocked. By having the set of construction spacers tandemly linked together as they attach to the set of boards, the boards, with the exception of the first and last board of the set, would be attached to and supported by two construction spacers thereby generally increasing the strength and durability of the completed structural element as compared to structural elements using more conventional board attachment means. As this step is generally completed, the process 200 could proceed to step 206, securing other portions of the boards.

In step 206, securing other portions of the boards, another set of construction spacers can be applied to the other unattached ends of the set of boards to attach those second board ends to the second structural member as well as interlocking the second board ends to one another as the construction spacers connect to each other in a tandem fashion. Similarly as in the above step, the second support member can be initially marked by the operator (e.g., construction worker, carpenter and alike) to identify where the second end of the first board could be attached by the construction spacer. The construction spacer attachment process as generally outlined above can be repeated without additional need for marking of the second support member. As the process is repeated with the second set of construction spacers, the second board ends are attached to the second support member with proper alignment, spacing and attachment.

If so desired by the operator, a third or additional sets of construction spacers can be applied to the set of boards substantially implement enhanced structural integrity and durability to the structural element. These sets of construction spacers could be similarly applied to the middle portions of the boards to provide the middle portions with an interlocking cross bracing.

As this step is generally completed, the process 200 could proceed to back to step 204 for creation of other structural elements or the process 200 could proceed to optional step 208, securing a second set of boards to first set of construction spacers. If the first set of boards are used to construct a first type of structural element (e.g., a flooring) and the building construction called for a second set of boards to make a second type of structural element (e.g., a wall) proximate to the first structural element, the lateral arms from the first set of construction spacers may be used to attach the second set of boards to a common structural member (e.g., a floor joist) As such, the second set of boards can be suitably procured and located proximate to the first and now common support member (e.g., the floor joist) and the first set of now attached floor boards.

The first board (e.g., wall board) from the second set of boards (e.g., wall) could be placed so that an end of that first wall board could be located upon the floor joist. The unattached portion of the lateral arm of the first construction spacer (e.g., attaching the first floor board to the floor joist) can be suitably bent by the operator upwards so as to come into contact with the lengthwise edge of the first wall board. That portion of the lateral arm can then be attached (e.g., by suitable fastener[s]) to a portion of the lengthwise edge of the first wall board to substantially hold the first wall board in a generally perpendicular alignment proximate to the first floor board that is also being held by the first construction spacer. A second wall board can then be bought up, aligned, and attached to the second construction spacer (e.g., floor) by that construction spacer's bent up lateral arm. This attachment procedure can be repeated until all the wall boards are attached to all of the floor construction spacers. Another set of construction spacers can then be used (in a manner as previously described above) to anchor the remaining ends of the wall boards to a second support member for completion of the second structural element (e.g., wall.)

In some embodiments, additional materials (e.g., boards, not belong to the set of wall boards) may be over laid upon the lateral arms and the common structural member, the first ends of the wall boards abutting the additional materials, and being held to the second materials by the lateral arms.

After the substantial completion of this step, the process 200 could proceed back to step 204 for the completion of other structural elements.

CONCLUSION

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

As substantially described and illustrated in the present application, the invention may provide a construction spacer or bracket that can hold two boards in spaced-apart and parallel orientation, the construction spacer can then be used to secure the boards to support members. The construction spacers could be further constructed to allow tandem (e.g., front-to-back) attachment of construction spacers to one another. In this manner, a set of construction spacers holding a set of boards could be used to easily align and attach a set of boards to a support member to form a structural element of a building construction.

What is claimed is:

1. A construction spacer used to hold boards apart in a parallel manner, comprising:

(A) a Y-shaped base having a definite length terminating in a first base end and a second base end, the first base end being wider than the second base end to form a C-shaped aperture;

(B) a pair of J-shaped attachment arms, each J-shaped attachment arm comprising a strip with a first strip end and second strip end that forms a hook portion, both hook portions are constructed to engage and hold a first board, each J-shaped attachment arm being perpendicularly attached in a spaced-apart manner to the first base end, the pair of J-shaped attachment arms further descending from the Y-shaped base;

(C) a pair of lateral support arms, each lateral support arm attaches to and extends outward from the first base end;

(D) an L-shaped attachment arm that terminates in a first plate end and a second plate end, the first plate end perpendicularly attaches to and descends from the second base end, the second plate end projects out a tab that forms a catch that faces the hook portions, the catch is constructed to engage and hold a second board parallel to and spaced apart from the first board, the L-shaped attachment arm being parallel to and spaced apart from the pair of J-shaped attachment arms, the L-shaped attachment arm and the pair of J-shaped attachment arms being perpendicular to the Y-shaped body;

wherein the C-shaped aperture of one construction spacer is sufficiently wide enough to accept the second base end of the another construction spacer to connect the one construction spacer second base end to another construction spacer's first base end to hold the one construction spacer's Y-shaped base and another construction spacer's Y-shaped base in tandem and planar alignment to each other.

2. The construction spacer of claim 1 wherein the hook portion comprises of a strip base and a strip tip, the strip base is perpendicularly connected to a non-hook portion of the respective second strip end, the strip base further perpendicularly attaches to the strip tip to hold the strip tip apart from and parallel to the non-hook portion.

3. The construction spacer of claim 1 wherein a pair of J-shaped attachment arms of the one construction spacer are in a spaced-apart manner that allows the pair of J-shaped attachment arms to straddle a Y-shaped body from the another construction spacer.

4. The construction spacer of claim 3 wherein the spaced-apart manner of the pair of J-shaped attachment arms of the one construction spacer allows the pair of J-shaped attachment arms to straddle a catch from the another construction spacer.

5. The construction spacer of claim 1 wherein the first base end is larger than the second base end, the first base end further being triangular in shape.

6. The construction spacer of claim 1 wherein the first base end has spaced-apart support extensions, the support extensions further defining the C-shaped aperture.

7. The construction spacer of claim 6 wherein each of the support extensions further supports the respective J-shaped attachment arm and the respective lateral support arm.

8. The construction spacer of claim 1 wherein the Y-shaped base further forms a U-shaped depression that forms holding cups in the first base end and the second base end.

9. The construction spacer of claim 8 wherein the holding cups are constructed to receive and support a lengthwise edge of the first board.

10. The construction spacer of claim 1 wherein the hook portions and catch are constructed to receive and support a lengthwise edge of a second board.

11. The construction spacer of claim 1 wherein the L-shaped attachment arm and the J-shaped attachment arms are on the same side of the Y-shaped base.

* * * * *